US005159163A

United States Patent [19]

Bahjat et al.

[11] Patent Number: 5,159,163

[45] Date of Patent: Oct. 27, 1992

[54] ELEVATOR MANAGEMENT SYSTEM TIME BASED SECURITY

[75] Inventors: Zuhair S. Bahjat, Farmington, Conn.; Michael Appelt; Stephanie A. Szekeres, both of Berlin, Fed. Rep. of Germany

[73] Assignee: Otis Elevator Company, Farmington, Conn.

[21] Appl. No.: 799,574

[22] Filed: Nov. 27, 1991

[51] Int. Cl.[5] ..... B66B 3/00

[52] U.S. Cl. ..... 187/133; 187/126

[58] Field of Search ..... 187/126; 340/147; 361/172

[56] References Cited

U.S. PATENT DOCUMENTS

| | | | |
|---|---|---|---|
| 3,428,148 | 2/1969 | Jacobs | 187/126 |
| 4,026,389 | 5/1977 | Magee | 187/126 |
| 4,157,133 | 6/1979 | Corcoran et al. | 187/126 |

*Primary Examiner*—A. D. Pellinen
*Assistant Examiner*—Lawrence E. Colbert
*Attorney, Agent, or Firm*—Francis J. Maguire, Jr.

[57] ABSTRACT

A method of operating an elevator system includes the steps of specifying and storing at least one profile describing at least one elevator operational characteristic, including an elevator security function specifying a landing or landings for which hall calls are not to be responded to and a landing or landings for which car calls are not to be responded to. The profile has a start time, an end time, and a day or days of the week specified therefor during which time the profile is to be activated. A next step repetitively determines a current time and a current day of the week and compares the current time and current day of the week to the specified start time, end time, and day or days of the week associated with the at least one stored profile. Responsive to an equality condition, the method includes a further step of transmitting information to a controller of at least one elevator car within a group of elevator cars. The transmitted information causes the at least one elevator car to begin operating in accordance with the specified profile, or to stop operating in accordance with the specified profile.

17 Claims, 9 Drawing Sheets fig. 4

```
                    One Corporate Park                    22-JAN-1990 11:30:59
SECURITY OPERATIONS                LOW RISE

                                                   ACC
                                                   ACC
                                                   ACC  ~ 126
                                                   ACC
                                                   ACC
                                                   SEC
                                                   ACC
                                                   ACC
                                                   AC
```

fig. 5

```
EMS 2.0                    Corporate Center Building        1-MAR-1991  13:17:35
                                   Directory

                                                Start  End   SMTWTFS  Status--State
Group
Group 1    Week Day Profile Group 1             06:00 18:00  MTWTF    ON      ACTIVE
Group 2    Mon, Wed, Friday Profile             09:00 16:30  M W F    ON      ACTIVE
Group 3    Conference Days                      08:15 17:00   T T     OFF     INACTIVE
Group 4    Week End Profile                     06:00 23:59 S     S   OFF     INACTIVE

<Space>, <+>, and <-> to toggle  <F1> master menu                     <F4> more
```

*fig. 6*

```
EMS 2.0                Corporate Center Building      1-MAR-1991  13:17:35
                              Profile

Group                Name                     Start  End  SMTWTFS  Status--State
GROUP 1     Week Day Profile Group 1          06:00 18:00  MTWTF   ON      ACTIVE

SECURITY:

Landings: BBL000000000111111111122222222223333333333444444444445
          21B123456789012345678901234567890123456789012345678901234567890
Hall : F  SA-------------------------------------------SSSSSSSSSSSS
       R  SS-------------------------------------------SSSSSSSSSSSS
Door : F  SA-------------------------------------------SSSSSSSSSSSS
       R  SS-------------------------------------------SSSSSSSSSSSS

CAR COMMANDS:          1    2    3    4    5    6    7    8
ATTENDANT OPER.        ON   OFF  ---  ---  ---  ---  ---  ON

GROUP COMMANDS:
UP PEAK                ON
GROUP SECURITY         OFF

CAR PARAMETERS:      TYPE   1    2    3    4    5    6    7    8
LBY DWELL TIME       TIME   15   15   15   15   20   20   20   20

GROUP PARAMETERS:    TYPE
LOBBY POSITION     LANDING  3

 <Space>, <+>, and <-> to toggle  <F1> master menu
```

*fig.7*

```
 EMS 2.0              Corporate Center Building     1-MAR-1991   13:17:35
                          Default Profile   Group_1

SECURITY:

Landings: BBL000000000111111111122222222223333333333444444444444
          21B123456789012345678901234567890123456789012345678901234567890
Hall : F  SA-------------------------------------------SSSSSSSSSSSS
       R  SS-------------------------------------------SSSSSSSSSSSS
Door : F  SA-------------------------------------------SSSSSSSSSSSS
       R  SS-------------------------------------------SSSSSSSSSSSS

CAR COMMANDS:          1     2     3     4     5     6     7     8
ATTENDANT OPER.        ON    OFF   ---   ---   ---   ---   ---   ON

GROUP COMMANDS:
UP PEAK                ON
GROUP SECURITY         OFF

CAR PARAMETERS:       TYPE   1     2     3     4     5     6     7     8
LBY DWELL TIME        TIME   15    15    15    15    20    20    20    20

GROUP PARAMETERS:     TYPE
LOBBY POSITION       LANDING  3

 <Space>, <+>, and <-> to toggle  <F1> master menu              <F4> more
```

ELEVATOR MANAGEMENT SYSTEM TIME BASED SECURITY

TECHNICAL FIELD

This invention relates to elevator systems and, in particular, to method and apparatus for specifying elevator security profiles and for automatically executing specified elevator security profiles at predetermined times.

BACKGROUND OF THE INVENTION

Modern elevator systems often include distributed intelligence in the form of elevator car controllers, such as microprocessors. Elevator operational parameters are inputted to the controllers for specifying operations such as door dwell time, lobby dwell time, velocity profiles, hall call intervals, car call intervals, etc. One feature that may be specified is related to elevator security. That is, certain floors of a building may be removed from elevator service for hall calls and/or car calls.

However, conventional systems require that such security information be manually specified on a daily basis. As such, it can be realized that this is not an optimum method of specifying and controlling elevator security in that errors in security specification may occur or, due to unforeseen circumstances, a required security specification may not be entered at all.

It is thus one object of the invention to provide a method, and apparatus for accomplishing the method, that enables a security profile to be specified and stored. Thereafter, the profile is automatically executed during specified times and on specified days of the week without requiring any operator intervention.

It is another object of the invention to provide a time based elevator profile. The profile has a start time and an end time associated therewith, such that a controller is enabled to automatically start and end the profile at prescribed times.

SUMMARY OF THE INVENTION

The foregoing and other problems are overcome and the objects of the invention are realized by an elevator control method and apparatus that provides a capability to specify, store, and automatically initiate and terminate one or more elevator profiles.

In accordance with a method of the invention, and apparatus for accomplishing the method, there is disclosed a method of operating an elevator system by the steps of (a) specifying at least one profile describing at least one elevator operational characteristic, including an elevator security function specifying a landing or landings for which hall calls are not to be responded to and a landing or landings for which car calls are not to be responded to. The profile has a start time, an end time, and a day or days of the week specified therefor during which time the profile is to be activated. A further step (b) stores the at least one profile. A next step (c) repetitively determines a current time and a current day of the week and compares the current time and current day of the week to the specified start time, end time, and day or days of the week associated with the at least one stored profile. Responsive to the comparison indicating that the current time equals either the start time or the end time, and to the comparison indicating that the current day of the week equals one of the specified days of the week, the method includes a further step of (d) transmitting information over a communication bus to a controller of at least one elevator car within a group of elevator cars. The transmitted information then causes the at least one elevator car to begin operating in accordance with the specified profile, or to stop operating in accordance with the specified profile.

The step of specifying preferably also specifies elevator group commands, elevator car commands, elevator group parameters, and elevator car parameters.

Furthermore, and responsive to a determination that an elevator car controller is not executing a specified one of the profiles, the method includes a step of transmitting information over the communication bus to the controller of at least one elevator car within the group of elevator cars for causing the at least one elevator car to begin operating in accordance with a default profile.

The elevator security function may specify, on a front car door and on a rear car door basis, a landing or landings for which hall calls are not to be responded to and a landing or landings for which car calls are not to be responded to.

BRIEF DESCRIPTION OF DRAWINGS

The foregoing aspects of the invention will be made more apparent in the ensuing Description when read in conjunction with the accompanying drawings, wherein:

FIG. 4 depicts a display screen showing a status of security operations that is a feature of the Elevator Management System;

FIG. 5 depicts a master director display for four elevator groups that is a feature of the time based profiles of the invention;

FIG. 6 illustrates a display screen for specifying one of the time based profiles of FIG. 5;

FIG. 7 illustrates a display screen for specifying a default time based profile for one of the elevator groups of FIG. 5;

DETAILED DESCRIPTION OF THE INVENTION

Figure 1:
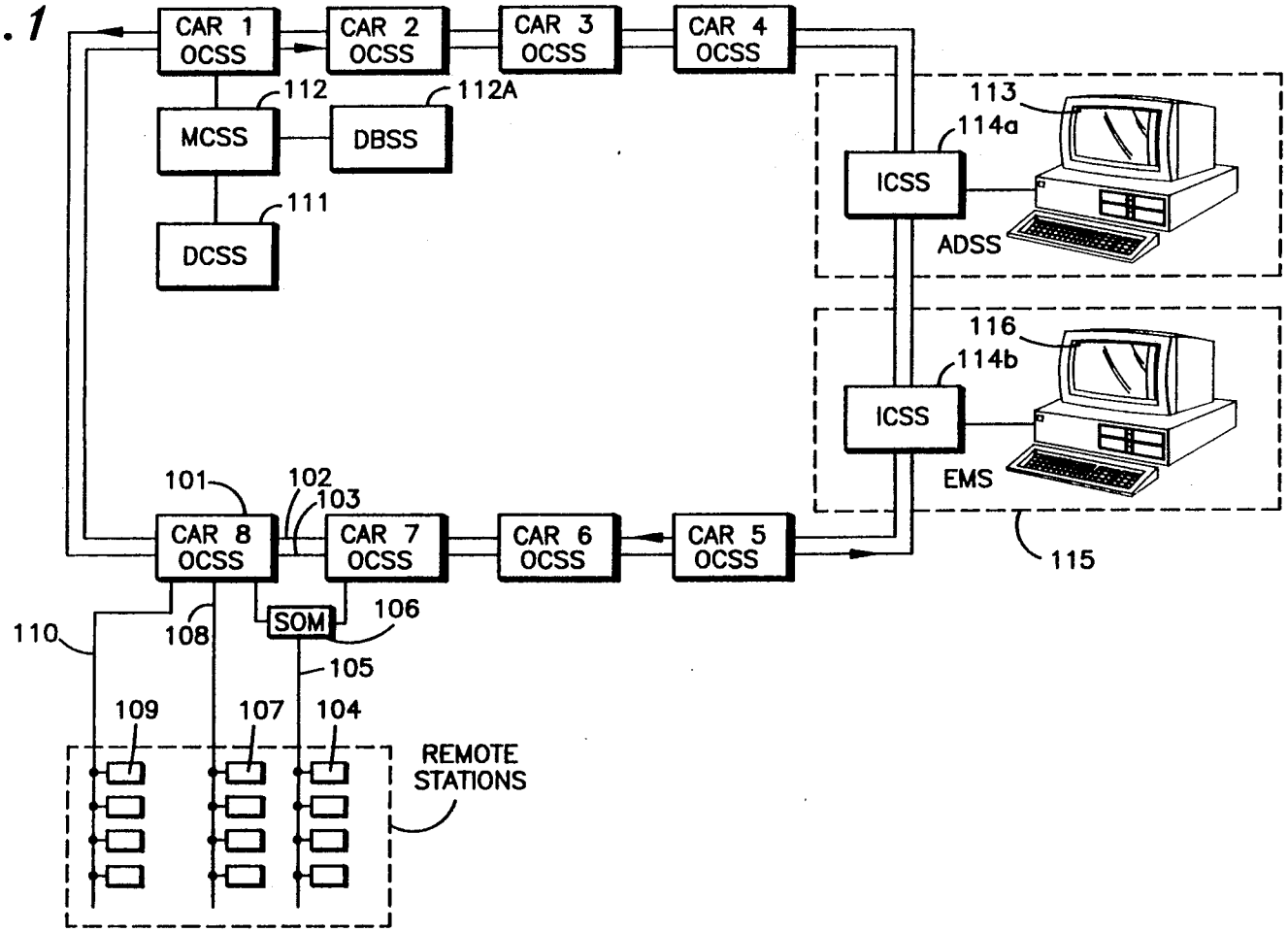
FIG. 1 is a block diagram of an elevator system that is constructed and operated in accordance with the invention.

FIG. 1 is a block diagram that depicts an elevator system of a type described in co-pending and commonly assigned U.S. patent application Ser. No. 07/029,495, entitled "Two-Way Ring Communication System for Elevator Group Control", filed Mar. 23, 1987. This elevator system presents but one suitable configuration for practicing the present invention. As described therein, an elevator group control function may be distributed to separate data processors, such as microprocessors, on a per elevator car basis. These microprocessors, referred to herein as operational control subsystems (OCSS) 101, are coupled together with a two-way ring communication bus (102, 103). For the illustrated embodiment the elevator group consists of eight elevator cars (CAR 1-CAR 8) and, hence, includes eight OCSS 101 units.

For a given installation, a building may have more than one group of elevator cars. Furthermore, each group may include from one to some maximum specified number of elevator cars, typically a maximum of eight cars.

Hall buttons and lights are connected with remote stations 104 and remote serial communication links 105 to each OCSS 101 via a switch-over module (SOM) 106. Elevator car buttons, lights, and switches are coupled through similar remote stations 107 and serial links 108 to the OCSS 101. Elevator car specific hall features, such as car direction and position indicators, are coupled through remote stations 109 and a remote serial link 110 to the OCSS 101.

It should be realized that each elevator car and associated OCSS 101 has a similar arrangement of indicators, switches, communication links and the like, as just described, associated therewith. For the sake of simplicity only those associated with CAR 8 are shown in FIG. 1.

Car load measurement is periodically read by a door control subsystem (DCSS) 111, which is a component of a car controller system. The load measurement is sent to a motion control subsystem (MCSS) 112, which is also a component of the car controller system. The load measurement in turn is sent to the OCSS 101. DCSS 111 and MCSS 112 are preferably embodied within microprocessors for controlling the car door operation and the car motion, under the control of the OCSS 101. The MCSS 112 also works in conjunction with a drive and brake subsystem (DBSS) 112A.

A car dispatching function is executed by the OCSS 101, in conjunction with an advanced dispatcher subsystem (ADSS) 113, which communicates with each OCSS 101 through an information control subsystem (ICSS) 114*a*. By example, the measured car load is converted into boarding and deboarding passenger counts by the MCSS 112 and sent to the OCSS 101. The OCSS 101 subsequently transmits this data over the communication buses 102, 103 to the ADSS 113, via the ICSS 114*a*. Also by example, data from a hardware door dwell sensor mounted on the car's door frame senses boarding traffic, and this sensed information is provided to the car's OCSS 101. This information may used by the OCSS 101, in conjunction with the ADSS 113, to process the information and, as appropriate, vary the door dwell time through the DCSS 111.

As such, it can be seen that the ICSS 114*a* functions as a communication bus interface for the ADSS 113, which in turn influences high level elevator car control functions.

For example, the ADSS 113 may collect data on individual car and group demands throughout the day to arrive at a historical record of traffic demands for different time intervals for each day of the week. The ADSS 113 may also compare a predicted demand to an actual demand so as to influence elevator car dispatching sequences executed by individual OCSS 101*s* so as to obtain an optimum level of group and individual car performance.

A feature of the elevator system that is most germane to the present invention is an Elevator Management System (EMS) 115. The EMS 115 includes an EMS Security Station (EMS-SS) 116 embodied in, by example, a personal computer or a work station. The EMS-SS 116 is coupled to the other components of the elevator system via a second ICSS 114*b* and the ring communication bus 102, 103.

In general, the EMS 115 enables building personnel to display and modify preprogrammed elevator operations through the EMS-SS 116. The EMS-SS 116 provides facilities to display and enable modification of the following operations: Elevator security display and operation; Elevator control functions; and Elevator parameter modification functions. Examples of these features include security, group commands, car commands, group parameters, and car parameters. By utilizing these features building personnel are enabled to tailor the elevator system performance to building traffic patterns.

Figure 2:
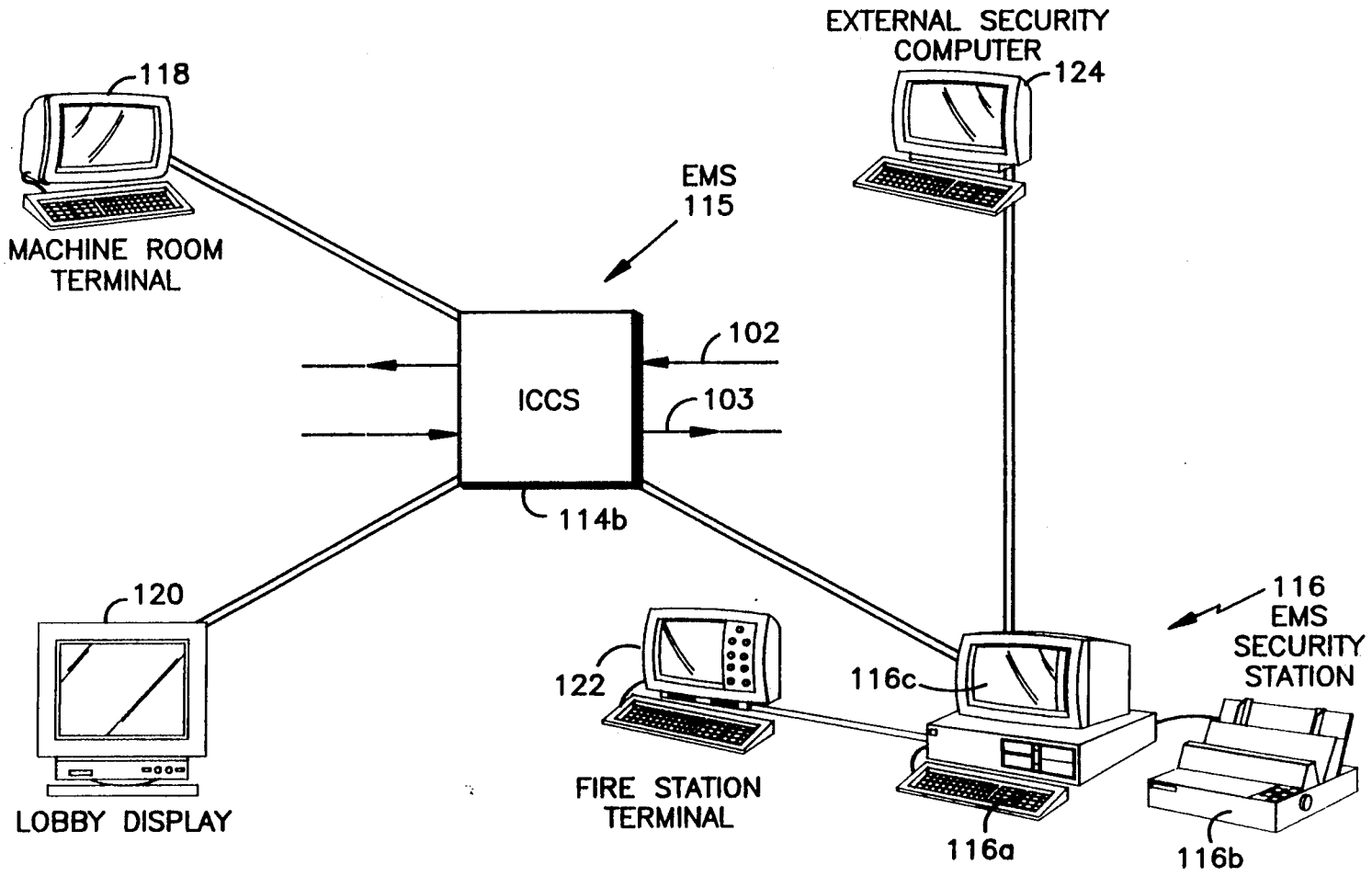
FIG. 2 is a block diagram that shows in greater detail the Elevator Management System of FIG. 1.

Referring to FIG. 2, the EMS 115 is seen to include the EMS-SS 116 which includes a keyboard 116*a* for enabling operator input and a printer 116*b* and CRT display 116*c* for providing a visual output to the operator. By example only, and not as a limitation upon the practice of the invention, the EMS 115 may also include an elevator machine room terminal 118, for use by service personnel, and a lobby display 120 for graphically displaying the status of the elevator group. These two components are coupled to the system via the ICSS 114*b*. Bi-directionally coupled to the EMS-SS 116 may be a fire station terminal 122 and a remote external security terminal 124.

Figure 3:
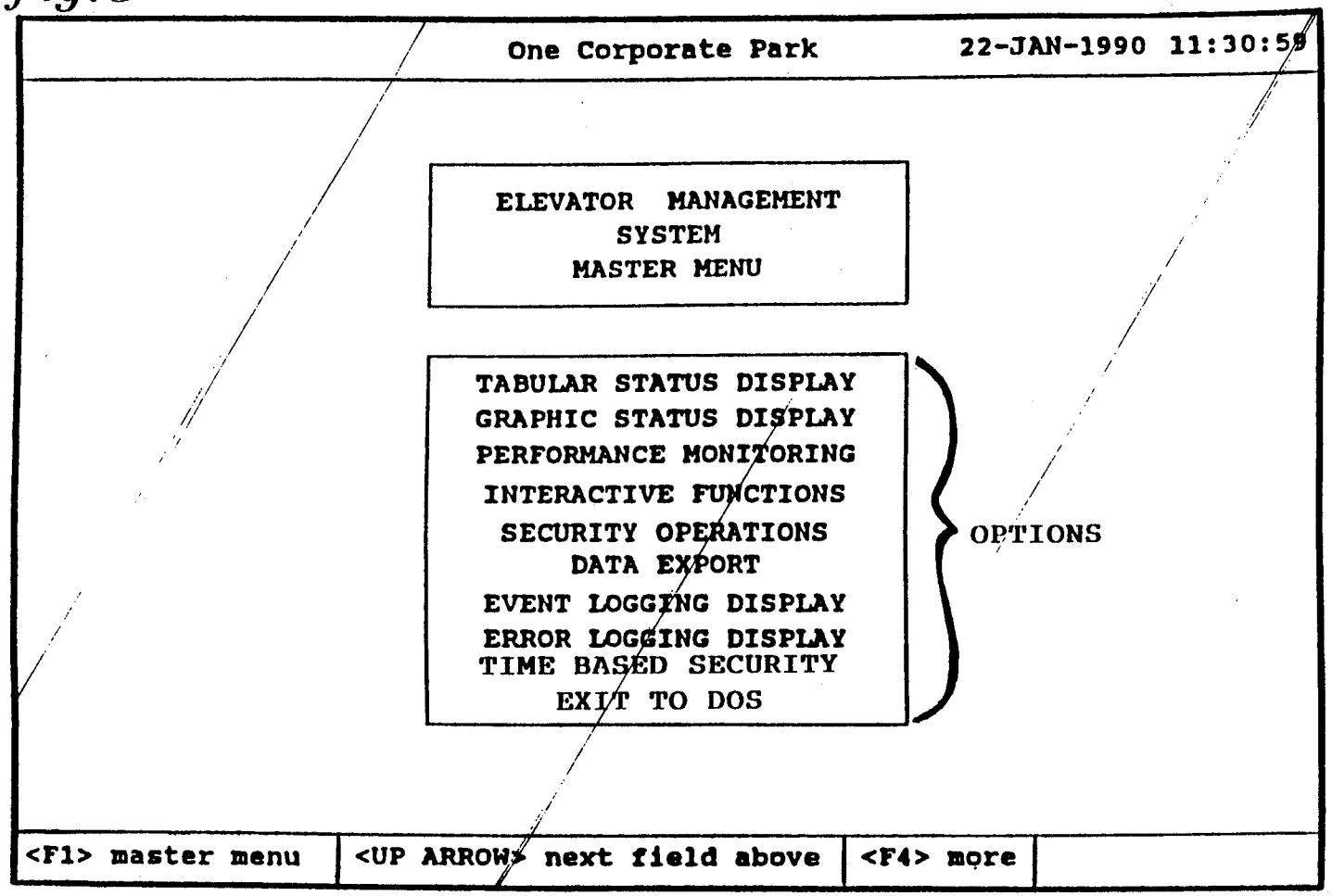
FIG. 3 depicts a display screen menu that is a feature of the Elevator Management System.

A master menu that is displayed to an operator of the EMS-SS 116 is shown in FIG. 3. A number of options are presented for selection by the operator.

By example, if selected the Tabular Status display shows car position, car direction, door position, car operational mode, load weight indication, group operations mode, event indications, and alarm indications. Additional information may also be provided, such as building name, EMS version number, elevator number, elevator group number, the date, and the current time.

If selected, the Graphic Status Display graphically illustrates car position, car direction, door position, car operational mode, load weight indication, hall calls registered (front and rear), car calls registered, car calls secured, hall calls secured, group operational mode, event indications, and alarm indications. As for the Tabular Status display, other information such as building name, EMS version number, elevator number, elevator group, date, and time may also be provided.

The Car Operation Report indicates elevator car activity during a specified time interval. The number of car runs, door operations, and door reversals for each car are displayed. A total for each category is also displayed.

For this option, the Door Operations information indicates a number of transitions the elevator car door makes from a "fully closed" position to a "fully open" position and back to a "fully closed" position. The Door Reversals information indicates a number of transitions the elevator car door makes from a "closing state" to an "opening state", without first reaching a "fully closed" state. The Car Runs information indicates a number of transitions the car makes from an "idle" state to a "normal" state, i.e., the car is moving.

A Landing Summary indicates to the operator the number of car and hall calls, per landing, during a specified time interval. For each landing, the number of front and rear car calls, up hall calls, and down hall calls are shown. The totals for each category are displayed.

A further master menu selectable function, the Interactive Functions, allows modification of preprogrammed elevator operations that are typically controlled by key switches. Using the Interactive Functions feature building personnel can initiate car calls and hall calls from the EMS-SS 116 for every group connected to the EMS-SS 116, from the Machine Room Terminal 118 for a specific group. Some examples of group functions are hall calls, group security operation, up peak operation, and down peak operation. Examples of car functions initiated by this menu option are car parking operations and car calls.

Having thus described some of the functionality of the EMS 115, a description of the Security Operations feature will now be provided.

The Security Operations feature provides for a display of and modification to hall call (front and rear car door) floor service cutoff. The Security Operations feature also provides for display of and modification to car call floor service cutoff.

As employed herein, a floor is considered to be secured if a hall call made from that floor is ignored, and/or if a car call to that floor is ignored. This feature is typically employed to restrict or prohibit access to one or more floors of the building. By example only, a restriction of access to some or all floors may be desired at specified times and days of the week, such as between 7:00 PM to 6:00 AM Monday through Thursday, and between 7:00 PM Friday to 6:00 AM Monday.

FIG. 4 illustrates an exemplary display screen for a three car group operating in a nine story building that also includes a basement (B) landing. As can be seen, the Front Hall Call (FHC) landing on the fourth floor is secured (SEC), while all other FHC landings are accessible (ACC). If the elevator cars are provided also with rear doors, a Rear Hall Call (RHC) column shows the RHC SEC/ACC status on a landing by landing basis. Also, it can be seen that each of the three cars is secured from car calls to the fourth floor landing, while car calls to all other landings are enabled and accessible. Many other combinations of hall call and car call securities are possible. By example, car calls to landings 3–9 could be secured to Cars 1 and 2, while car calls to all landings could be enabled to Car 3.

The operator interacts with the EMS-SS 116 via the keyboard 116*a* to select an elevator group for which the security status is to be viewed or changed. By example, depression of one key positions a cursor 126 over one of the displayed fields, such as the car call status for Car 3 for landing 7. Depression of the space bar key toggles the status between ACC and SEC.

The aforementioned security functions are conventionally entered manually, on a daily basis, by an operator of the EMS-SS 116.

In accordance with the invention there is now described a Time Base Security feature that enables the operation of automatic elevator security profiles that are based upon time of day and day of week. Up to some predetermined number of profiles, such as 40, are entered and stored by the EMS-SS 116. These profiles span some predetermined number of elevator groups, such as eight elevator groups. The profiles are assignable to a particular group on a configurable basis, such as five profiles per group for eight groups, or 10 profiles for Group 1 and 30 for Group 2, etc. Each profile allows for the selection of functions which correspond to a schedule. There is also defined a default profile for each group which is active on power up and during any unscheduled times. All functions that may be selected for a time based profile are also available for inclusion within the default profile(s).

It is noted that for a system employing more than one group of elevator cars, that an additional ICSS 114*b* is employed for each additional group. Each ICSS 114*b* is coupled to the EMS-SS 116 and also to the ring communication bus (102, 103) of the associated group.

Each time based profile includes a start time and a stop time. Time is referenced to a real time clock that is maintained, in a conventional fashion, by the EMS-SS 116. A time range may be specified over a boundary between two consecutive days, such as 7:00 PM to 6:00 AM. If the start and stop times are equal, the profile is considered to be active for a 24 hour period. A day of week range is selectable from a matrix defining Sunday through Saturday. Days need not be contiguous. That is, a given profile may be defined to be active only on Monday, Wednesday, and Friday. The first selected day defines the day that the profile begins.

In operation, the EMS-SS 116 continuously scans the set of defined profiles and compares them to a current time and day so as to initiate and terminate the profiles. automatically. If a profile start time equals the current time, and if the profile defined day of the week equals the current day, then the various parameters specified by the profile are transmitted via the ICSS 114*b* to the specified OCSS 101 units of the specified group. It is also a configurable function to log the starting and stopping of each profile to the printer 116*b* and/or to an Event file maintained within a memory of the EMS-SS 116. Another configurable option reminds the operator, when entering manual settings in a conventional fashion, that a time based profile is active. As a result, the operator may choose to override the time based schedule with a manually entered schedule.

In greater detail, the operator is enabled to establish one or more profiles which are stored and maintained by the EMS-SS 116. Each profile may define the hall call security and the car call security for a given group of elevator cars, in a manner depicted in FIGS. 5 and 6. The profile is then automatically started and stopped at prescribed times and days, alleviating the previous requirement of manually entering the desired security features on a daily basis.

In addition to these security features, each time based profile may also define the following elevator system commands and parameters.

TABLE 1

| |
|---|
| GROUP COMMANDS: |
| No Lobby Bypass |
| Up Hall Call Bypass |
| Dual Up Peak |
| Emergency Power Operation |
| Group Security Operation |
| Down Peak |
| Intergroup Emergency Power |
| Separate Riser |
| Group Special Emergency Service |
| Firemens Service Phase I |
| CAR COMMANDS: |
| Firemens Service Phase II |
| Cancel Advanced Door Opening |
| Car Out of Group |
| Speech Hush |
| Speech Mute |
| Attendant Operation |
| Independent Service |
| Park Car and Shut Down |
| Emergency Power Operation-Return |
| Emergency Power Operation-Normal |
| Cancel Anti-Nuisance |

TABLE 1-continued

| |
|---|
| GROUP PARAMETERS: |
| Lobby Position |
| CAR PARAMETERS: |
| Car to Landing |
| Velocity Profile |
| Light and Fan Interval |

FIG. 5 illustrates a master directory display of time based profiles for four elevator groups (Group 1 to Group 4). A time based profile is assigned an identifying Name. The directory shows the profile Start Time, End Time, the days of week for which the profile is specified to be active, a current Status of the profile (ON or OFF), and a State of the profile (Active or Inactive). By accessing this directory screen the operator is notified of the current status and state of the time based profile(s) specified for each elevator group.

FIG. 6 illustrates a display screen for one of the time based profiles, specifically the time based profile for Group 1. By interacting with this display screen via the keyboard 116*a* the operator is enabled to specify the various profile parameters. Certain of the fields that are specified by this profile screen, such as profile Name, Start Time, and End Time, are accessed for display on the master menu screen of FIG. 5.

For the illustrated embodiment there are two basement landings (B2, B1), a Lobby landing (LB), and 50 floor landings. Both front and rear hall and door calls are specified as being Secured (S) or Accessible (A) for all of the cars of Group 1. By example, both front and rear door hall calls and car calls are secured for landing B2 and for landings 39–50 for all cars on Monday through Friday between 6:00 and 18:00. In addition, rear door hall calls and car calls are secured for landing B1. All other landing hall calls (front and rear) and car calls are accessible during this period.

Also specified for Group 1 during this period is attendant operation for cars 1 and 8. The UP Peak group command is specified as being ON, and Group security is specified as being OFF. Lobby Dwell Time for cars 1–4 is specified as being 15 seconds, while for cars 5–8 the specified Lobby Dwell Time is 20 seconds. During the specified activation period (6:00–18:00) the Lobby Position is specified as being landing 3.

After interacting with this screen, the operator depresses a key, such as the page up/down key, to obtain a further screen. By this method the operator specifies the various parameters set forth in Table 1. When completed, the time based profile for Group 1 is stored within the memory of the EMS-SS 116.

FIG. 7 illustrates a display screen that is presented to the operator for specifying, in the same manner, the Default time based profile for Group 1. As was previously stated, the Default time based profile is executed during any time when another time based profile is not specified for a group. Modifications to the Default profile are made by the operator in a manner previously described.

Figure 8:
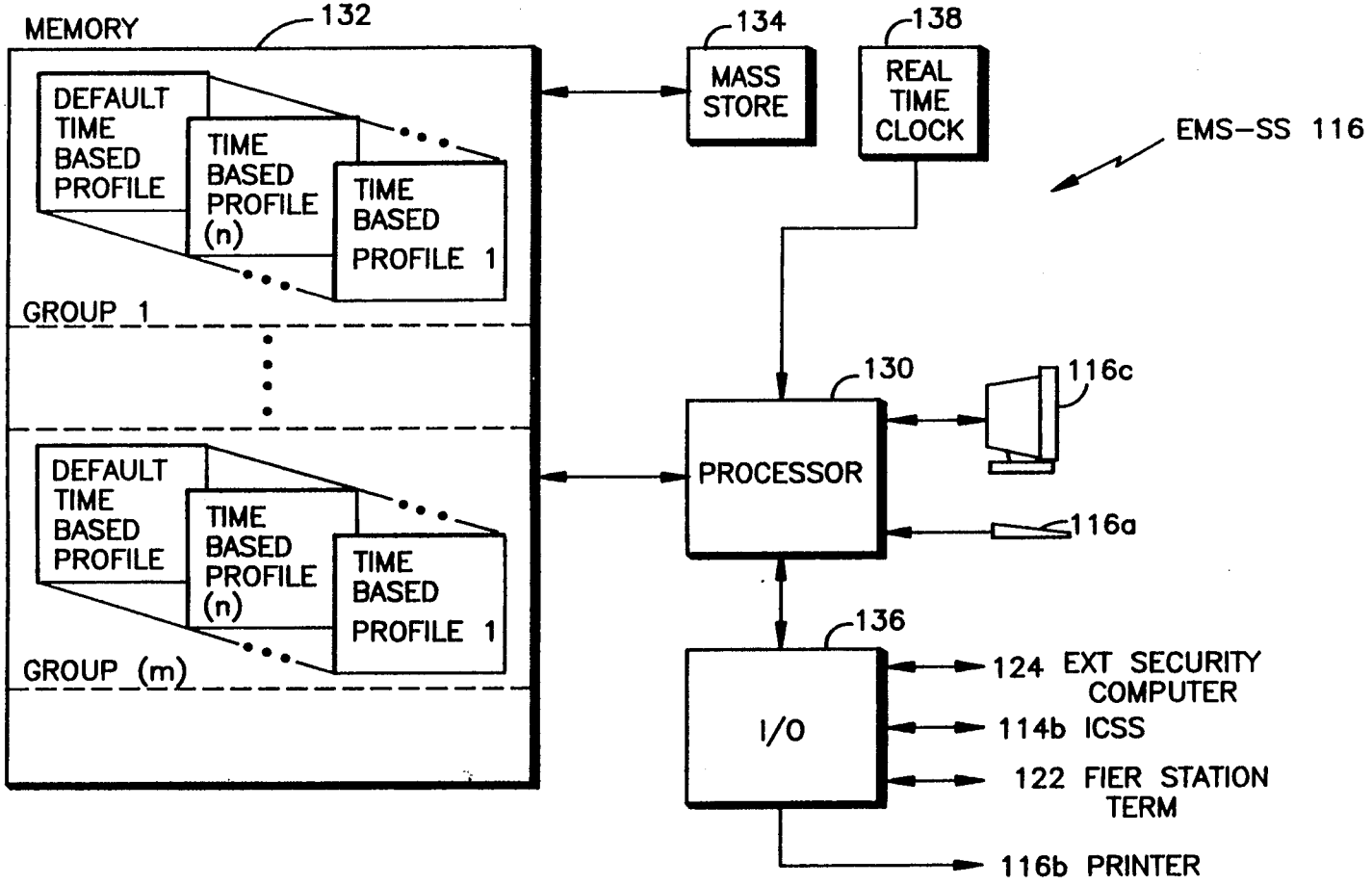
FIG. 8 is a block diagram of an embodiment of an Elevator Management System Security Station.

FIG. 8 is a block diagram that illustrates in greater detail the EMS-SS 116, and specifically the components thereof that interact with the operator to specify, store, and execute the time based profiles.

The EMS-SS 116 includes a processor 130 that is coupled to the display 116*c* and the keyboard 116*a*. Also coupled to the processor 130 is a memory 132 wherein are stored the specified time based profiles for Group 1-Group (m). For each group there is stored from one to (n) time based profiles. A Default time based profile is also stored for each group. A mass storage device 134, such as a magnetic disk, is provided for long term, nonvolatile profile storage. The mass storage device 134 also stores instructions for executing the method of the invention. An I/O subsystem 136 is coupled to the processor and bidirectionally couples same to the ICSS 114*b*, the printer 116*b*, and to the fire station terminal 122 and the external security computer 124. The EMS-SS 116 also includes a real time clock 138 that is readably coupled to the processor 130.

Figure 9:
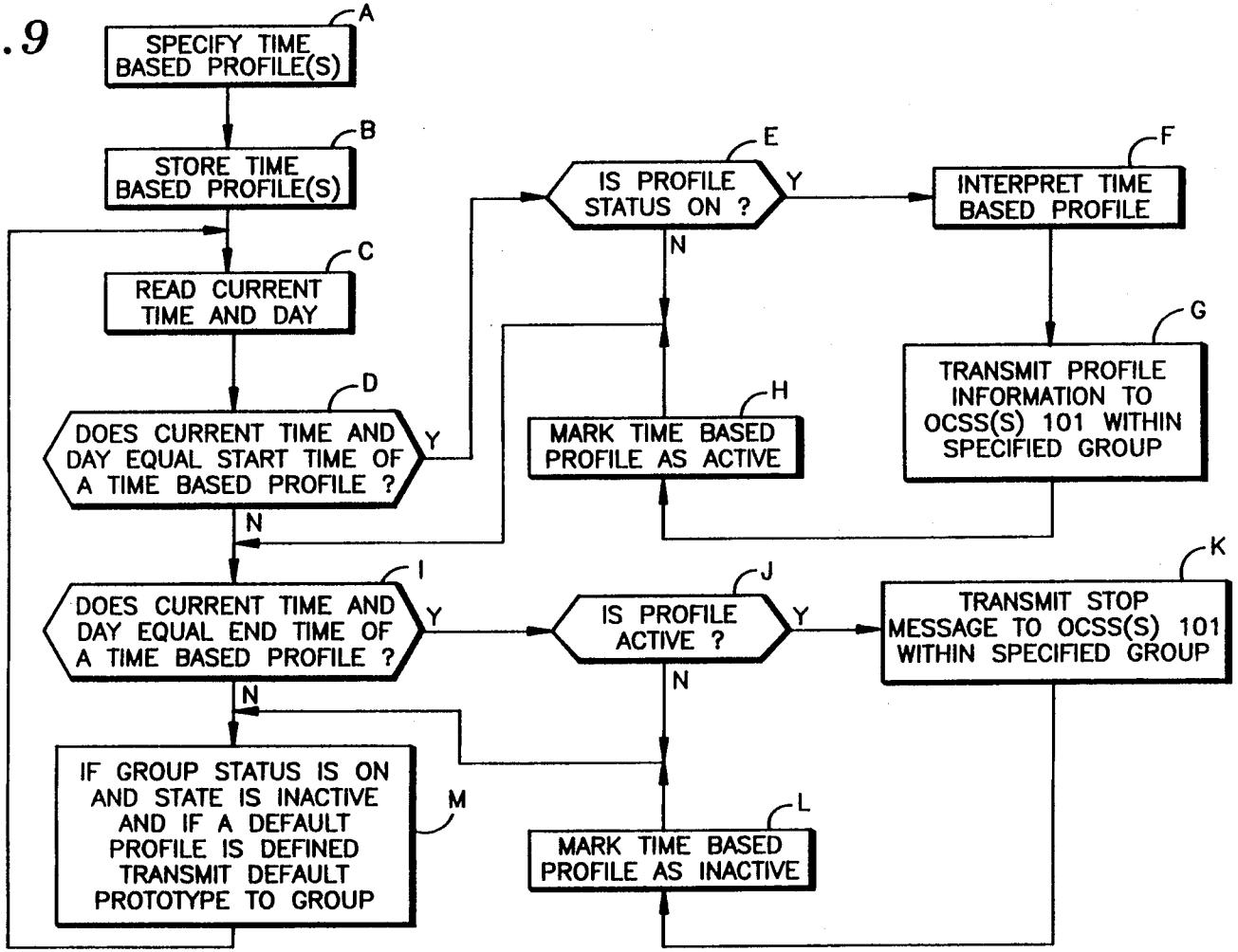
FIG. 9 is a flowchart depicting a method of the invention for specifying, storing, and executing time based elevator profiles.

In operation, and referring to the flow chart of FIG. 9, the processor 130 interacts with the operator through the display 116*c* and the keyboard 116*a* to specify and store the time based profiles (Blocks A and B). As a part of this interaction the processor 130 forms error checking on the entered data. For example, the processor 130 ensures that two profiles for a given group do not have overlapping activation times. If any errors are found the operator is signaled to correct the error.

Thereafter, the processor 130 periodically reads the time of day and the day of the week information from the real time clock 138 (Block C). In this regard, the real time clock 138 may provide time in hours and minutes and also the calendar date. From the calendar date the processor 130 is enabled to determine, by well known techniques, the day of the week.

A comparison is made at Block D to determine if the current time and day is equal to a start time for one of the time based profiles stored in memory 132. If YES, a determination is made at Block E if that profile's status is ON or OFF. If the profile status is ON, the time based profile is interpreted (Block F) and the profile information is transmitted to the OSCC(s) 101 within the specified group (Block G). The transmission is made via the I/O subsystem 136, the ICSS 114*b*, and the ring communication bus (102, 103). A transmission message includes an identifier for a specified one or ones of the OCSS 101. The message circulates about the ring communication bus (102, 103) and is received and interpreted by the addressed OCSS 101 units.

The processor 130 then marks the time based profile as ACTIVE (Block H).

Block I is executed if the result of the comparison in Block D is NO, if the result in the comparison in Block E is NO, and after executing Block H. At Block I another comparison is made to determine if the current time and day equal the specified end time of one of the time based profiles stored in memory 132. If YES, a determination is made at Block J if that profile is indeed ACTIVE. If YES, the processor 130 transmits a profile STOP message to the OCSS(s) 101 within the specified group (Block K). Control then passes to Block L where the processor 130 marks the time based profile as INACTIVE.

Block M is executed if the result of the comparison of Block I is NO, if the result of the comparison of Block J is NO, and after executing Block L. In Block M a determination is made if the group status is ON, if the group's state is INACTIVE, and if a default prototype is defined for the group. If so, the default prototype is transmitted to the OCSS(s) 101 within the group. Control then returns to Block C.

Although described in the context of a specific hardware and software embodiment it should be realized that a number of modifications may be made thereto. For example, the logical steps embodied in the flowchart of FIG. 9 may be executed in other than the order shown while still achieving the same result. For example, Block I could be executed before Block D. Also, the various profile information and parameters described above could be modified to include more or less than the number of parameters shown. Also, the practice of the invention is not limited only to an elevator system having the architecture illustrated in FIG. 1. By example, the ring communication bus could be replaced with a bus having a star configuration, with the EMS-SS 116 transmitting directly to and receiving directly from each OCSS 101. As such, the invention is not intended to be limited to only the illustrated embodiment, but is instead intended to be limited only as the invention is set forth in the claims which follow.

We claim:

1. A method of operating an elevator system, comprising the steps of:

specifying a profile describing at least one elevator operational characteristic, the profile having a start time, an end time, and at least one day of the week specified therefor;

storing the profile;

repetitively determining a current time and a current day of the week;

comparing the current time to the start time and to the end time associated with the stored profile and also comparing the current day of the week to the specified at least one day of the week; and responsive to the comparison indicating that the current time equals either the start time or the end time, and that the current day of the week equals the at least one specified day of the week, transmitting information to at least one elevator car within a group of elevator cars for then causing at least one elevator car to begin operating in accordance with the specified profile or to stop operating in accordance with the specified profile.

2. A method as set forth in claim 1 wherein the step of specifying includes a step of specifying an elevator security function.

3. A method as set forth in claim 2 wherein the step of specifying an elevator security function specifies a landing or landings for which hall calls are not to be responded to.

4. A method as set forth in claim 2 wherein the step of specifying an elevator security function specifies a landing or landings for which car calls are not to be responded to.

5. A method as set forth in claim 1 wherein the step of specifying specifies elevator group commands, elevator car commands, elevator group parameters, and elevator car parameters.

6. A method as set forth in claim 1 wherein the step of transmitting transmits the information to a ring communication bus, the ring communication bus having at least one elevator car controller coupled thereto.

7. An elevator system, comprising:

means for generating an indication of a current time, including a current day of the week; and control means, said control means including, means for receiving and storing at least one profile describing at least one elevator operational characteristic, the profile having a start time, an end time, and at least one day of the week specified therefor;

means, having an input coupled to an output of said time generating means, for comparing the current time to the start time and to the end time associated with the stored profile and for comparing the current day of the week to the at least one day of the week associated with the stored profile; and means, responsive to the comparison indicating that the current time equals either the start time or the end time, and that the current day of the week equals the at least one specified day of the week, for transmitting information to at least one elevator car within a group of elevator cars for causing the at least one elevator car to begin operating in accordance with the specified profile or to stop operating in accordance with the specified profile.

8. An elevator system as set forth in claim 7 wherein the receiving and storing means includes means for receiving and storing profile information specifying an elevator security function.

9. An elevator system as set forth in claim 8 wherein the profile information specifies a landing or landings for which hall calls are not to be responded to.

10. An elevator system as set forth in claim 8 wherein the profile information specifies a landing or landings for which car calls are not to be responded to.

11. An elevator system as set forth in claim 7 wherein the receiving and storing means includes means for receiving and storing profile information for specifying elevator group commands, elevator car commands, elevator group parameters, and elevator car parameters.

12. An elevator system as set forth in claim 7 wherein the means for transmitting is coupled to a communication bus for transmitting the information thereto, and wherein the communication bus has at least one elevator car control means coupled thereto for receiving the information and for operating the elevator car in accordance therewith.

13. A method of operating an elevator system, comprising the steps of:

specifying at least one profile describing at least one elevator operational characteristic, including an elevator security function specifying a landing or landings for which hall calls are not to be responded to and a landing or landings for which car calls are not to be responded to, the profile further having a start time, an end time, and a day or days of the week specified therefor during which time the profile is to be activated;

storing the at least one profile;

repetitively determining a current time and a current day of the week;

comparing the current time and current day of the week to the specified start time, end time, and day or days of the week associated with the at least one stored profile; and responsive to the comparison indicating that the current time equals either the start time or the end time, and to the comparison indicating that the current day of the week equals one of the specified days of the week, transmitting information over a communication bus to a control means of at least one elevator car within a group of elevator cars for causing the at least one elevator car to begin operating in accordance with the specified profile or to stop operating in accordance with the specified profile.

14. A method as set forth in claim 13 wherein the step of specifying specifies elevator group commands, elevator car commands, elevator group parameters, and elevator car parameters.

15. A method as set forth in claim 13 wherein the step of transmitting transmits the information to a ring communication bus, the ring communication bus having at least one of the elevator car control means coupled thereto.

16. A method as set forth in claim 13 wherein, responsive to a determination that an elevator car control means is not executing a specified one of the profiles, includes a step of transmitting information over the communication bus to the control means of at least one elevator car within the group of elevator cars for causing at least one elevator car to begin operating in accordance with a default profile.

17. A method as set forth in claim 13 wherein the elevator security function specifies, on a front car door and on a rear car door basis, a landing or landings for which hall calls are not to be responded to and a landing or landings for which car calls are not to be responded to.

* * * * *